US011208999B2

(12) United States Patent
Straub et al.

(10) Patent No.: US 11,208,999 B2
(45) Date of Patent: Dec. 28, 2021

(54) ELECTRIC MOTOR AND ROD-DRIVEN ROTARY GEAR PUMPS

(71) Applicant: ADVANCING PUMP TECHNOLOGY CORP., Calgary (CA)

(72) Inventors: Peter Straub, Calgary (CA); Kim Pollard, Calgary (CA)

( * ) Notice: Subject to any disclaimer, the term of this patent is extended or adjusted under 35 U.S.C. 154(b) by 0 days.

(21) Appl. No.: 16/079,545

(22) PCT Filed: Feb. 27, 2017

(86) PCT No.: PCT/CA2017/050251
§ 371 (c)(1),
(2) Date: Aug. 23, 2018

(87) PCT Pub. No.: WO2017/143459
PCT Pub. Date: Aug. 31, 2017

(65) Prior Publication Data

US 2019/0072090 A1 Mar. 7, 2019

Related U.S. Application Data

(60) Provisional application No. 62/299,780, filed on Feb. 25, 2016.

(51) Int. Cl.

| | |
|---|---|
| ***E21B 43/12*** | (2006.01) |
| ***F04C 13/00*** | (2006.01) |
| ***F04C 2/10*** | (2006.01) |
| ***F04C 2/18*** | (2006.01) |
| ***F04C 15/00*** | (2006.01) |

(52) U.S. Cl.
CPC ..... *F04C 13/008* (2013.01); *E21B 43/126* (2013.01); *E21B 43/128* (2013.01); *F04C 2/101* (2013.01); *F04C 2/18* (2013.01); *F04C 15/008* (2013.01); *F04C 15/0061* (2013.01)

(58) Field of Classification Search
CPC ..... E21B 43/128; E21B 43/126; F04C 13/008
See application file for complete search history.

(56) References Cited

U.S. PATENT DOCUMENTS

| | | | | |
|---|---|---|---|---|
| 1,568,836 A * | 1/1926 | Hawley, Jr. | F04C 13/008 | 166/106 |
| 1,593,820 A * | 7/1926 | Gates | F04B 47/04 | 417/390 |
| 4,830,113 A * | 5/1989 | Geyer | E21B 17/206 | 166/369 |
| 4,913,239 A * | 4/1990 | Bayh, III | E21B 17/003 | 166/105 |
| 5,421,780 A * | 6/1995 | Vukovic | E21B 17/02 | 464/102 |
| 5,860,864 A * | 1/1999 | Vukovic | E21B 17/05 | 464/147 |
| 5,871,051 A * | 2/1999 | Mann | E21B 43/121 | 166/377 |
| 6,056,054 A * | 5/2000 | Brady | E21B 43/385 | 166/105.5 |
| 6,268,672 B1 * | 7/2001 | Straub | E21B 43/128 | 166/105 |

(Continued)

*Primary Examiner* — Giovanna Wright
(74) *Attorney, Agent, or Firm* — Bennett Jones LLP

(57) ABSTRACT

A downhole pumping apparatus comprising a positive displacement rotary gear pump (RGP), driven by a rotating rod string or a submersible electric motor.

20 Claims, 10 Drawing Sheets

(56) References Cited

U.S. PATENT DOCUMENTS

| | | | | |
|---|---|---|---|---|
| 6,518,684 | B1 * | 2/2003 | Schaich | F04C 15/0061 310/103 |
| 8,987,957 | B2 * | 3/2015 | Knapp | H02K 7/08 310/87 |
| 2007/0196229 | A1 * | 8/2007 | Gay | F04C 2/084 418/206.1 |
| 2014/0370995 | A1 * | 12/2014 | Collins | E21B 17/02 464/138 |
| 2015/0060055 | A1 * | 3/2015 | Tolman | E21B 43/126 166/250.01 |

* cited by examiner

ELECTRIC MOTOR AND ROD-DRIVEN ROTARY GEAR PUMPS

FIELD OF THE INVENTION

This invention relates generally to a downhole pumping apparatus comprising a positive displacement rotary gear pump (RGP) which is driven by a rotating rod string or a submersible electric motor.

BACKGROUND

Specific challenges arise in oil production when it is desired to extract heavy, sandy, gaseous or corrosive high temperature oil and water slurries from underground wells. These slurries may range over the breadth of fluid rheology from highly viscous, heavy, cold crude to hot thermal fluids. Recent technological advances have permitted well to be sunk vertically, and then to continue horizontally into an oil producing zone. Thus wells can be drilled vertically, on a slant, or horizontally. There is a continuing need for efficient and reasonably economical means to extract slurries from wells of these types, referred to generally as artificial lift solutions.

Various artificial lift systems are well known. For example, pump jack pumps employ sucker rod pumping with a down-hole plunger pump. This is a reciprocating beam pumping system that includes a surface unit (a gearbox, Pittman arms, a walking beam, a horsehead and a bridle) that causes a rod string to reciprocate, thereby driving a down-hole plunger pump. Pump jack systems are popular in certain instances but have a number of well-known disadvantages.

Progressive cavity pumps employ a single helical rotor, usually a hard chrome screw, rotates within a double helical stator that may be a steel stator or elastomer bonded within a steel tube. Progressive cavity pumps also have disadvantages. First, they tend not to operate well, if at all, at high temperatures. It appears that the maximum temperature for continuous operation of a PCP in a well bore is about 180 F (80 C). It is desirable that the pump be able to operate over a range of −30 to 350 C (−20 to 650 F), and that the pump be able to remain in place during steam injection. As well, progressive cavity pumps tend not to operate well "dry" and are not suitable for operations which involve high gas-oil ratios (GORs).

Electric submersible pumps (ESP) include a down-hole electric motor that rotates an impeller (or impellers) in the pump, thereby generating pressure to urge the fluid up the tubing to the surface. Electric submersible pumps typically operate at high rotational speeds, and tend to be adversely affected by inflow viscosity limitations. They tend not to be suitable for use in heavy oil applications. Electric submersible pumps are also susceptible to contaminants. Electric submersible pumps are typically not positive displacement pumps, and consequently are subject to slippage and a corresponding decrease in efficiency. The use of electric submersible pumps may be limited by horsepower and temperature restrictions.

Jet pumps employ a high pressure surface pump to transmit pumping fluid down-hole. A down-hole jet pump is driven by this high pressure fluid. The power fluid and the produced fluid flow together to the surface after passing through the down-hole unit. Jet pumps tend to have rather lower efficiency than a positive displacement pump. Jet pumps tend to require higher intake pressures than conventional pumps to avoid cavitation. Jet pumps tend to be sensitive to changes in intake and discharge pressure. Changes in fluid density and viscosity during operation affect the pressures, thereby tending to make control of the pump difficult. Finally, jet pump nozzles tend to be susceptible to wear in abrasive applications.

Gas lift systems are artificial lift processes in which pressurized or compressed gas is injected through gas lift mandrels and valves into the production string. This injected gas lowers the hydrostatic pressure in the production string, thus establishing the required pressure differential between the reservoir and the well-bore, thereby permitting formation fluids to flow to the surface. Gas lift systems tend to have lower efficiencies than positive displacement pumps. They tend be uncontrollable, or poorly controllable, under varying well conditions, and tend not to operate effectively in relatively shallow wells. Gas lift systems only have effect on the hydrostatic head in the vertical bore, and may tend not to establish the required drawdown in the horizontal bore to be beneficial in SAGD application. Further, gas lift systems tend to be susceptible to gas hydrate problems. The surface installation of a gas lift system may tend to require a significant investment in infastructure—a source of high pressure gas, separation and dehydration facilities, and gas distribution and control systems. Finally, gas lift systems tend not to be capable of achieving low bottom-hole producing pressures.

Therefore, there remains a need in the art for a relatively efficient, high temperature, high volume pumping system that can accommodate a large range of production requirements, with the capability of being installed into, and operating from, the horizontal section of a well bore.

SUMMARY OF THE INVENTION

In an aspect of the invention, the invention comprises a downhole pumping apparatus comprising a positive displacement rotary gear pump (RGP), driven by a rotating rod string or a submersible electric motor, and conveyed in production tubing to produce fluid within the production tubing, or by coil tubing or cable within a liner.

BRIEF DESCRIPTION OF THE DRAWINGS

The following drawings form part of the specification and are included to further demonstrate certain embodiments or various aspects of the invention. The description and accompanying drawings may highlight a certain specific example, or a certain aspect of the invention. However, one skilled in the art will understand that portions of the example or aspect may be used in combination with other examples or aspects of the invention.

DETAILED DESCRIPTION

Figure 1:
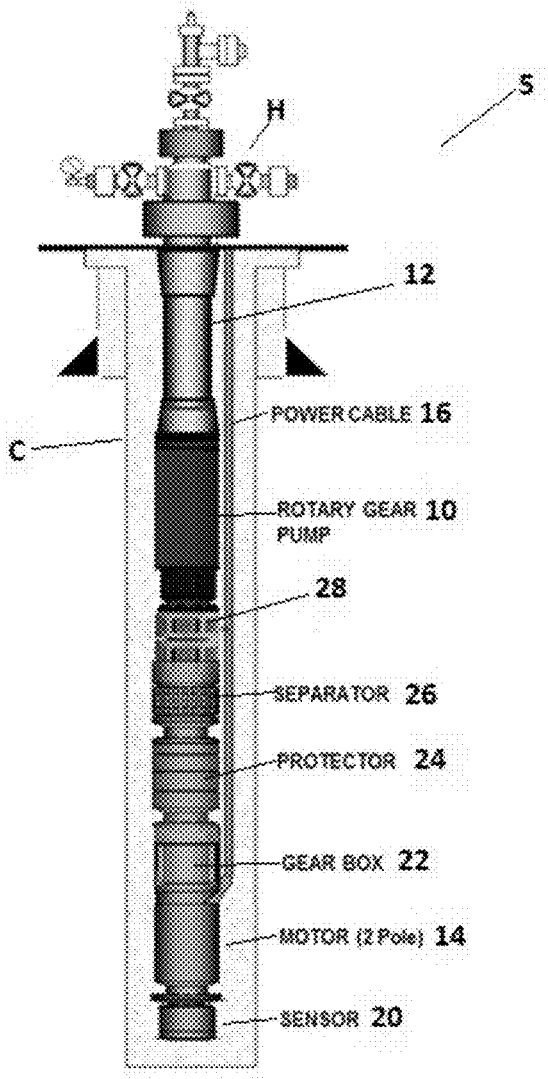
FIG. 1 shows a general schematic illustration of a pumping system comprising a rotary gear pump and an electric motor.
Figure 2:
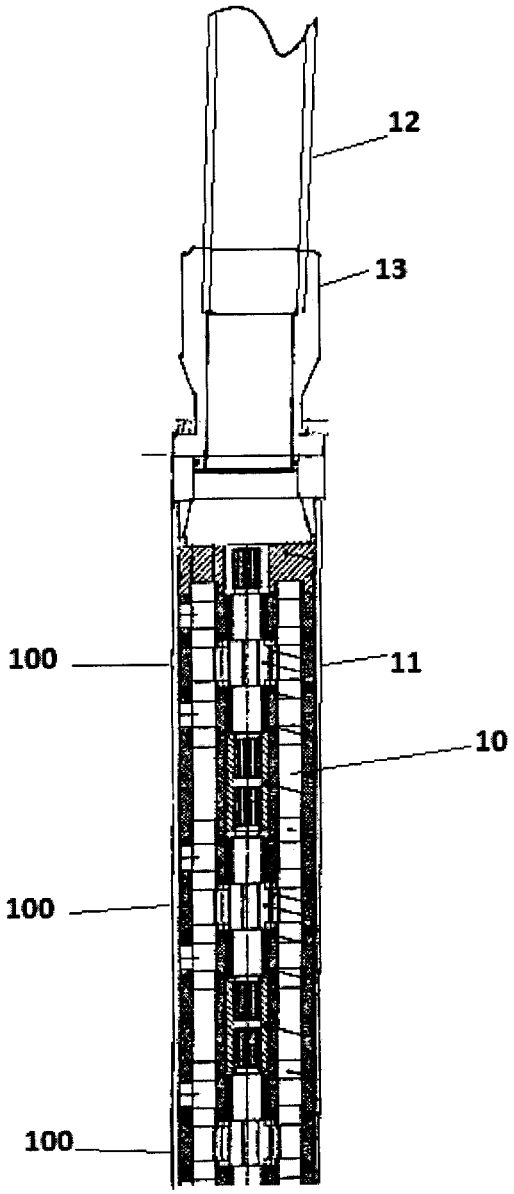
FIG. 2 shows a detail of the pump housing connection to the production tubing.

To the extent that the following description is of a specific embodiment or a particular use of the invention, it is intended to be illustrative only, and not limiting of the claimed invention. The following description is intended to cover all alternatives, modifications and equivalents that are included in the spirit and scope of the invention, as defined in the appended claims. References in the specification to "one embodiment", "an embodiment", etc., indicate that the embodiment described may include a particular aspect, feature, structure, or characteristic, but not every embodiment necessarily includes that aspect, feature, structure, or characteristic. Moreover, such phrases may, but do not necessarily, refer to the same embodiment referred to in other portions of the specification. Further, when a particular aspect, feature, structure, or characteristic is described in connection with an embodiment, it is within the knowledge of one skilled in the art to affect or connect such aspect, feature, structure, or characteristic with other embodiments, whether or not explicitly described.

In the drawings attached, the pump system (5) is shown in a vertical orientation, however, it is intended that the pump system may be installed and operated from a vertical section, a slant section, or a horizontal wellbore.

In one embodiment, the invention comprises a pump system (5) comprising a rotary gear pump (10) deployed into a well bore on jointed production tubing (12), and is driven from below by an electric motor (14). Power is delivered to the motor (14) with a power cable (16) extending to the surface and clamped or banded to the outside of the production tubing (12). Production fluids are driven up the production tubing. Surface equipment may include components to drive the electric motor, such as a transformer (not shown), variable frequency drive, a vented junction box, and a power cable to the well head (H) mounted on the well casing (C). Optionally, more than one rotary gear pump (10) may be provided, in a stacked configuration, operating either in series or parallel, or the gear pump may comprise multiple stages.

The rotary gear pump may be any positive displacement rotary gear pump, which are characterized by counter-rotating gears having meshing teeth which pump fluid by displacement. Specific embodiments are described below.

The motor (14) may comprise any electric motor suitable for downhole use, such as an AC induction motor, or a DC permanent magnet motor. Optionally, a plurality of electric motors may be provided, for example, connected in series to increase the horsepower of the pump system.

As shown schematically in FIG. 1, the system may comprise a sensor or monitoring device (20) mounted below the electric motor. Optionally, a gear box (22) may be used to increase or decrease the pump speed in relation to the motor speed, as determined by the design of the pump and the type of electric motor. A seal section or protector (24) protects the motor against ingress of well fluids and fine solids.

The monitoring device (20) may include sensors which collect data on such downhole conditions as intake pressure, motor internal temperature, vibration, pump discharge pressure, and the like, and transmits the data to the surface. Data transmission may take place through the electric motor power cable or a separate data cable, or via wireless telemetry, for storage and analysis. Additionally, this data may be used to vary pump operation parameters in a real-time control system. The variable speed drive (VSD) driving the electric motor can be programmed to take actions in response to this data. In SAGD applications, where bottom hole temperature (BHT) is too high for the electronics in the monitor to survive, simple gauges may be used to record limited data, which is the transmitted to the surface through a dedicated instrument wire, which may be encased in a small diameter conduit strapped to the production tubing along with the electric motor power cable.

The rotary gear pump (10) is enclosed within a housing (11), which mates to a tubing adapter (13), which connects to the production tubing (12).

The system may comprise a pump intake with an integral oil/gas separator (26) which separates at least a portion of any gas which may be entrained in the liquid phase, and vent the liberated gas to the casing annulus. Liquids are ported internally through a flex coupling (28) and up to the rotary gear pump (10).

The flex coupling (28) is required because the output shaft of the electric motor and/or gear box (22) is substantially along the axial centre line of the system, while the input shaft of the rotary gear pump is offset, as is described below. In an alternative embodiment, the flex coupling may be replaced by a gearbox may have an input shaft on the centre-line and an output shaft which is offset from the axial centre line, and aligned with an input shaft of the rotary gear pump (10).

Figure 3:
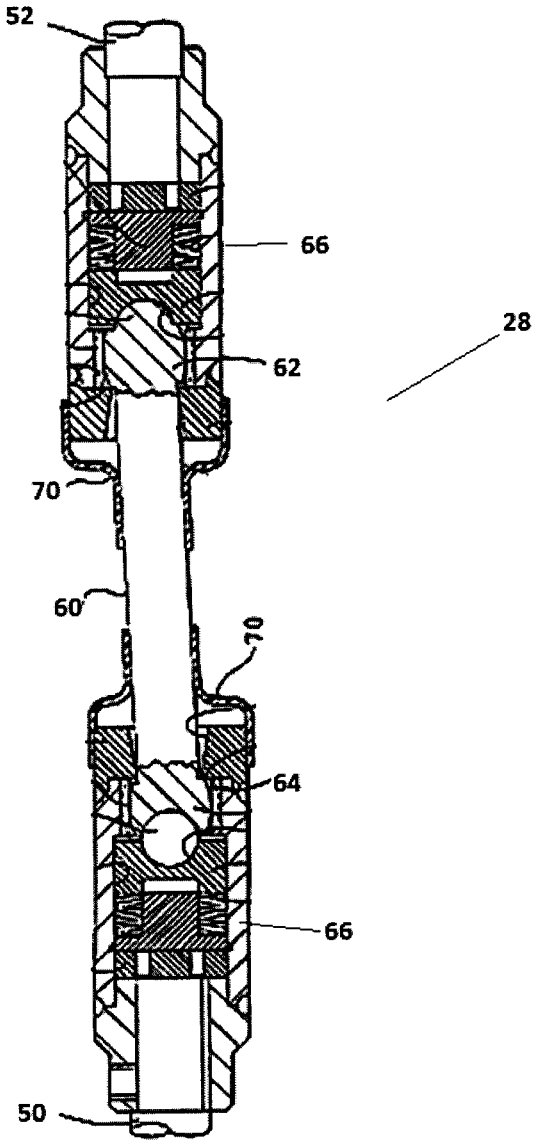
FIG. 3 shows an illustration of one example of a flex coupling.

In one embodiment, as shown in FIG. 3, the flex coupling (28) comprises a type of universal joint which transmits rotational torque where the input (50) and output (52) shafts are parallel but offset (not aligned), or are at angle to each other. A connecting shaft (60) ends with enlarged bodies (62, 64) received into a longitudinal opening or bore in a generally tubular housing (66). Each housing (66) is rigidly connected to an end of the drive shafts (50, 52) by means of keyways, set screws, bolts, or welding. A plurality of longitudinal splines extend from the curved lateral sides of the enlarged bodies (62, 64), and these splines are intermeshed with a plurality of longitudinal splines or grooves formed within the interior surface of the housing. The interaction of the splines and grooves, as well as the curved sides of the enlarged bodies permit a limited amount of lateral displacement or "wobble" of the ends of the connecting shaft (60) relative to the housings (66), yet the connecting shaft is rotationally connected to the drive shafts. In this manner, rotational movement and torque can be transmitted through the drive shaft 50, the connecting shaft (60), to the output drive shaft (52).

Grease or other suitable lubricants are provided within the flex coupling (28) to maintain freedom of movement of the parts. To aid in keeping the moving parts within the housing free of contaminants elastomeric boots or seals (70) are connected at one end to the connecting shaft (60) and at another end to the housing. Alternative embodiments may use variations of a flexible drive shaft, or other equivalent mechanisms known to those skilled in the art.

Figure 4:
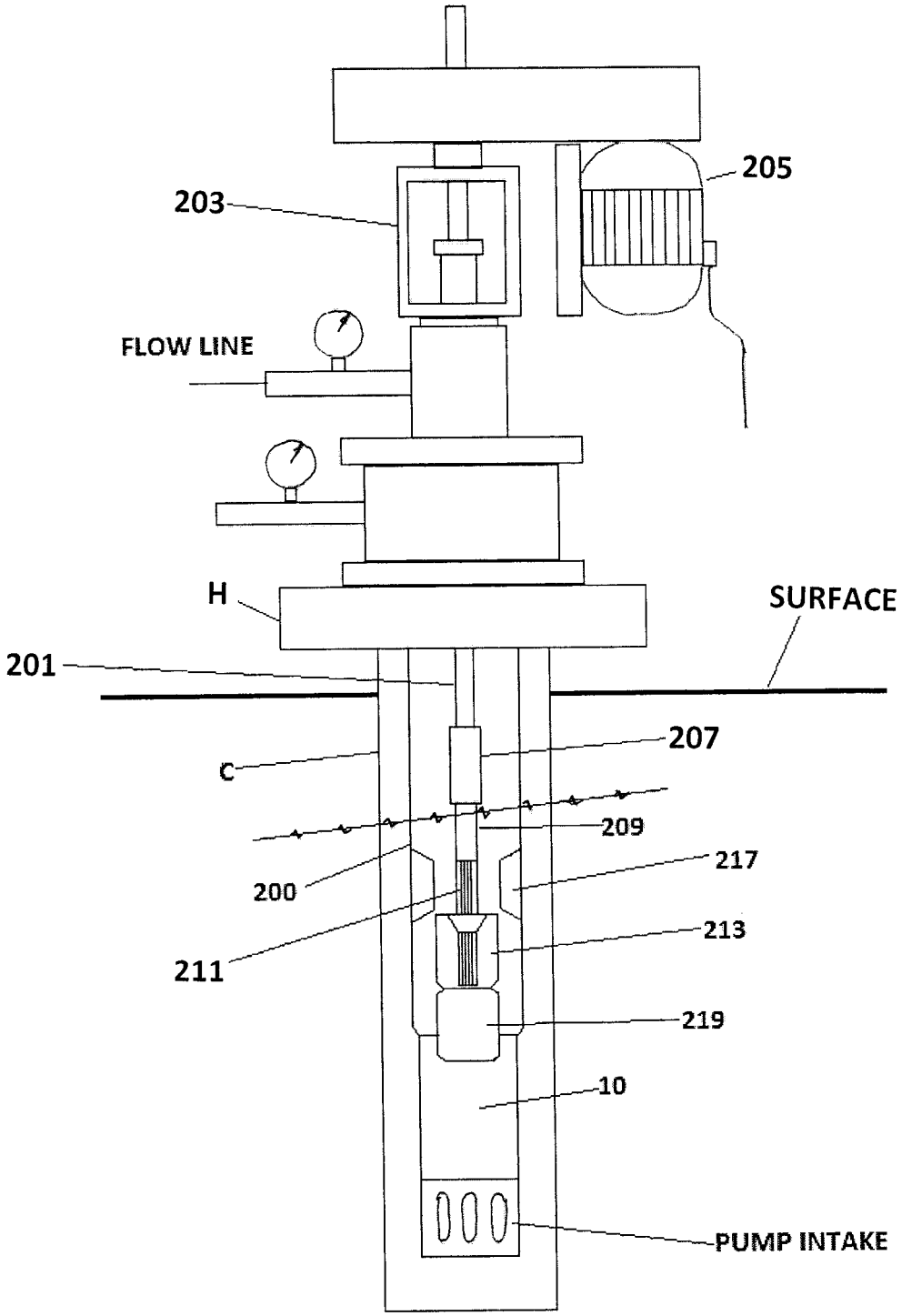
FIG. 4 shows a general schematic illustration of a pumping system comprising a rotary gear pump driven by a rotating sucker rod string.

In another embodiment, as shown schematically in FIG. 4, the invention may comprise a rotary gear pump (10) deployed into a well bore on coil or jointed production tubing (200), and driven by a rotating rod string (201) from the surface. The sucker rod string will be rotated by a drive unit (203) and a prime mover (205), which may be an electric motor attached to a well head (H) on the casing (C) at surface.

The rod string (201) rotates within the production tubing, and may be jointed rod, continuous rod, jointed tubing, or continuous tubing. Rotating drive rods are known to those skilled in the art but used primarily to drive progressive cavity pumps. In one embodiment, the drive rod (201) may be equipped with centralizers (207) to reduce tubing wear.

Figure 5:
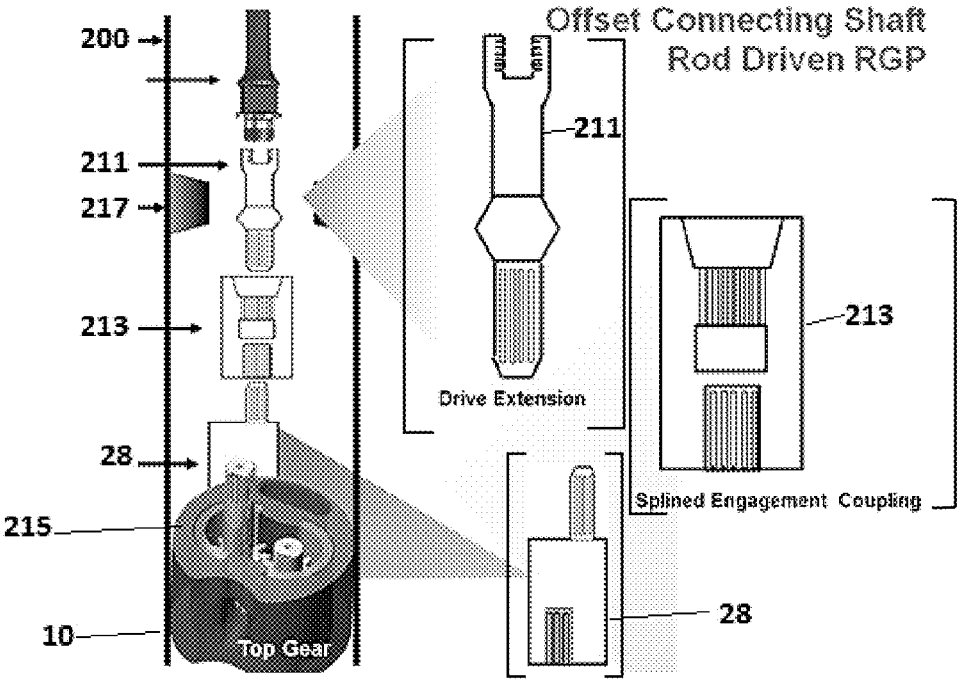
FIG. 5 shows another schematic of the system of FIG. 4.

To facilitate removal and replacement of the drive rod without disturbing the production tubing, the lower most rod or downhole end (209) of the rod string (201) may comprise a splined male probe or drive extension (211), which will then be guided into engagement with a female splined coupling (213) on the input shaft (215) of the pump, or to the input shaft of a gearbox (219) which may be either a speed increasing or decreasing gearbox. An annular centering sleeve (217) may be disposed on the inner surface of the production tubing. Alternatively, a splined engagement coupling (220) may provide an adapter In one embodiment, the gearbox also functions as an flex coupling (28), which may be necessary as it is desirable to centralize the drive rods (201) while the pump input shaft (215) may be offset from the axial centre line, as is shown in FIG. 5.

Figure 6:
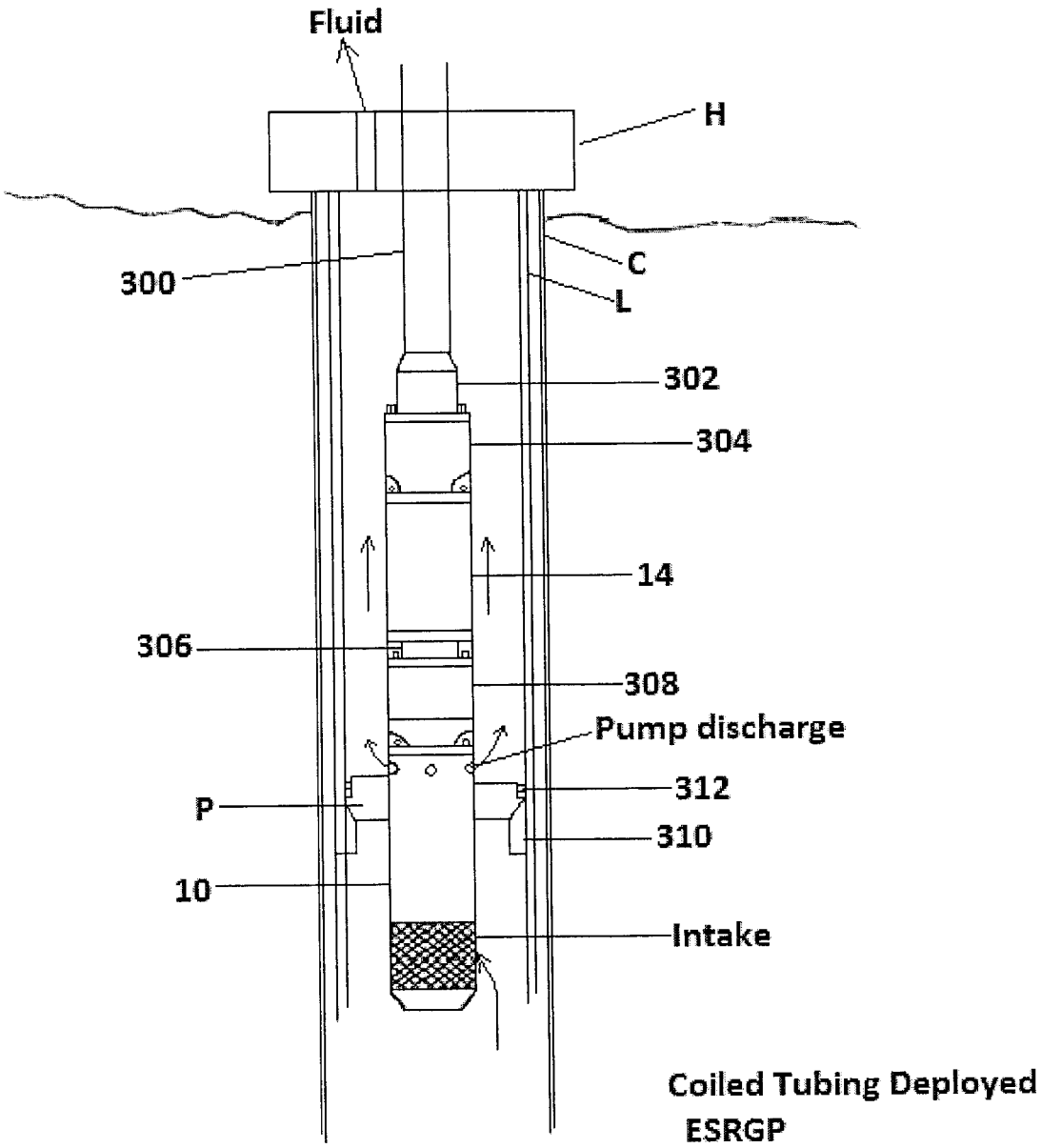
FIG. 6 shows an alternative embodiment of a rotary gear pump driven by an electric motor, deployed on coiled tubing.

In an alternative embodiment, as shown schematically in FIG. 6, the rotary gear pump (10) is deployed into a well bore on coiled tubing (300), and is driven from above by an electric motor (14). Power is delivered to the motor (14) with a power cable (not shown) which extends to the surface within the coiled tubing (300). Surface equipment may include components to drive the electric motor, such as a transformer (not shown), variable frequency drive (VFD), a vented junction box, and a power cable to the well head (H) mounted on the well casing (C). The coiled tubing (300) terminates with a tubing grapple (302) and a power connecting chamber (304), which attaches to the motor (14). A speed reducer gearbox (306) and a sealed thrust section (308) are disposed between the motor (14) and the pump (10). A flex coupling (28) is disposed above the pump (10), below the sealed thrust section (308).

The pumping unit is assembled into the well bore through a lubricator mounted on the BOP, allowing insertion and retrieval without the necessity to "kill" the well. A packer (P) or similar device is located on the pump between the intake and a pump discharge head, and produced fluids are driven to the surface through the well casing.

In some applications, it may be necessary to install a secondary casing, or liner, (L) possibly including a pump seating nipple (310), prior to deploying the pumping unit. This seating nipple (310) may be included near the bottom end of this secondary casing, and the pump is then located by and sealed into this seating nipple using appropriate seals (312), thereby isolating the high pressure pump discharge from the low pressure inlet. Produced fluid is forced to the surface through the liner, and cools the motor as it passes.

If desired, there may be an oil conduit (not shown) housed along with the electrical conductors in the coiled tubing. This conduit may be used to supply pressurized lubricating oil from a surface source to maintain positive pressure inside the motor and seal section, and/or to periodically flush the motor and seal section with clean oil.

Figure 7:
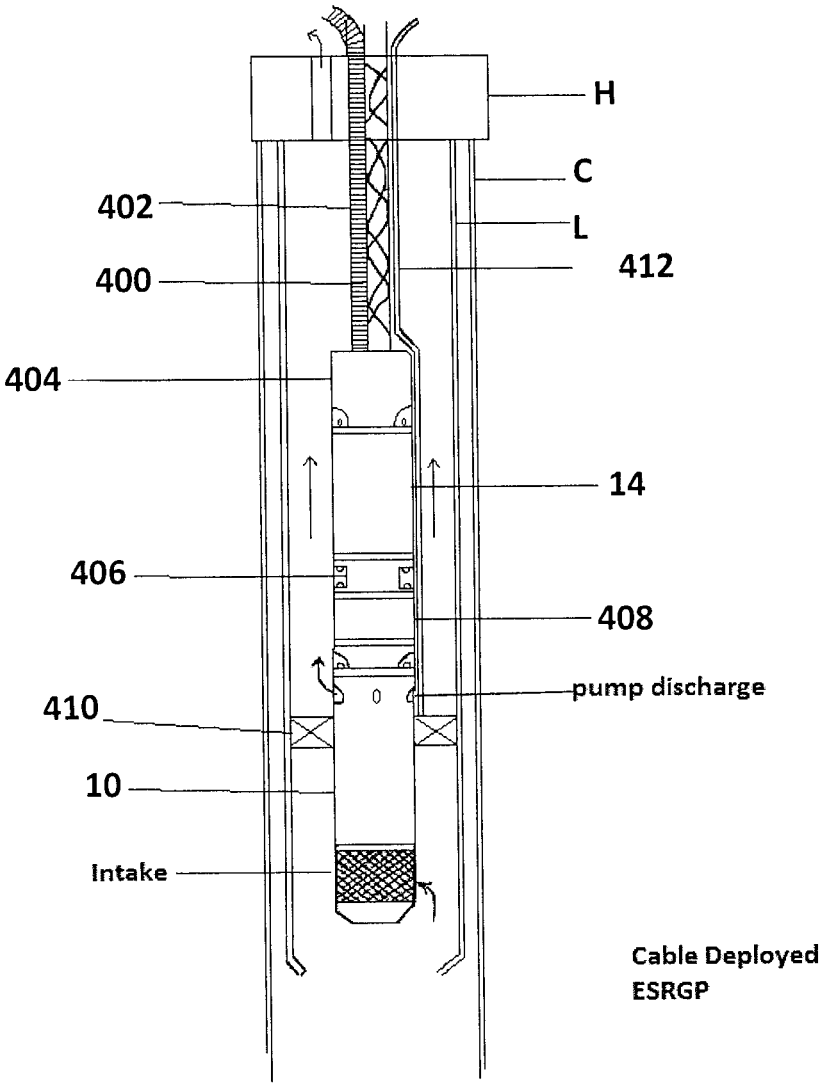
FIG. 7 shows a further alternative embodiment of a rotary gear pump driven by an electric motor, deployed on a cable.

In a further alternative, shown schematically in FIG. 7, the rotary gear pump (10) is deployed into a well bore on a torque-balanced wire rope cable (400), and is driven from above by an electric motor (14). Power conductors (402) are either incorporated into the cable, or strapped, clamped, or banded to the outside of the cable, and directly to the motor through a power connection chamber (404), without an external pothead. Surface equipment may include components to drive the electric motor, such as a transformer (not shown), variable frequency drive (VFD), a vented junction box, and a power cable to the well head (H) mounted on the well casing (C). The cable (400) terminates with the power connecting chamber (404), which attaches to the motor (14). A speed reducer gearbox (406) and a sealed thrust section (408) are disposed between the motor (14) and the pump (10). A flex coupling (28) is disposed above the pump (10), below the sealed thrust section (408).

If desired, there may be an oil conduit (not shown) provided along with the power cable. This conduit may be used to supply pressurized lubricating oil from a surface source to maintain positive pressure inside the motor and seal section, and/or to periodically flush the motor and seal section with clean oil.

The pump intake is positioned below a packer (410) which isolates the producing zone below the pump from the annular space above the packer. In some applications, it may be necessary to install a secondary casing, or liner (L). The packer may be actuated through a hydraulic control line (412) to surface. This line (412) or conduit would be clamped to the support cable along with the electrical power conductors. Produced fluid is forced to the surface through the liner, and cools the motor as it passes. As this example is suspended on a support cable, it is not applicable for horizontal application, since there is no means of forcing the packer section into a seating nipple to effect both location and isolation of pump intake from pump discharge.

Rotary Gear Pump

The common element to these pumping apparatuses is a positive displacement rotary gear pump (10), examples of which are described below.

Figure 8A:
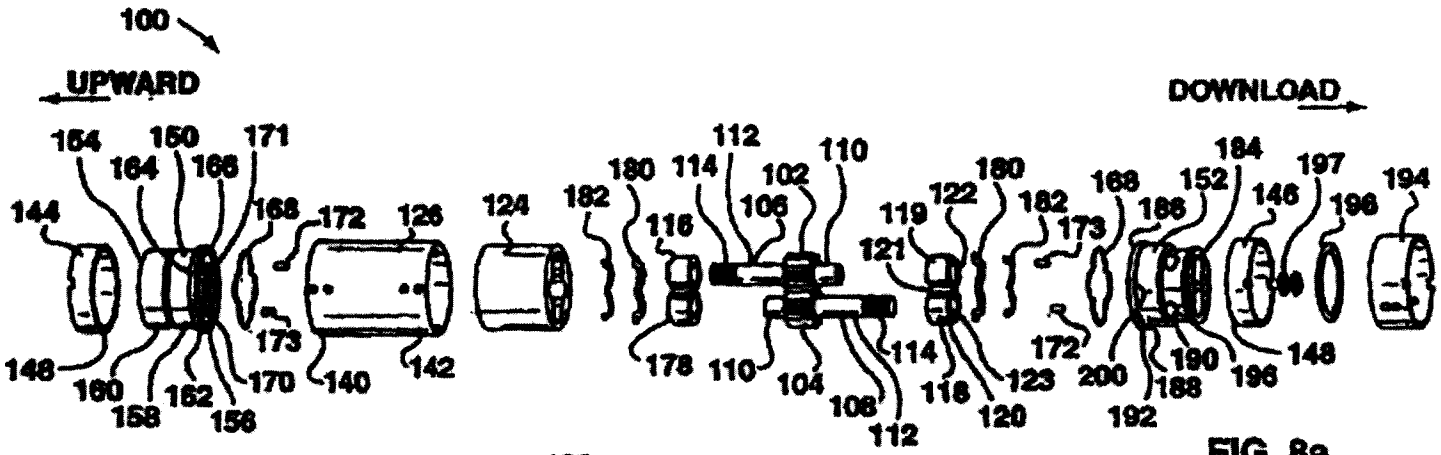
FIG. 8*a* shows an exploded view of one example of a positive displacement rotary gear pump assembly.

As shown in FIG. 8*a*, a pump stage comprises gear assembly 100 includes a pair of matched first and second gears 102 and 104 mounted to respective stub shafts 106 and 108. The pump (10) may comprise a plurality of stages (100) connected by coupling shafts (101) and union nuts (194).

Stub shafts 106 and 108 are parallel such that their axes lie in a common plane. When gears 102 and 104 engage, there is continuous line contact between mating lobes in a meshing region located between the axes of rotation of shafts 106 and 108 such that there is no clear passage between the engaging teeth. Stub shafts 106 and 108 are arranged such that gears 102 and 104 are mounted toward one end of their respective stub shafts, such that a short end 110 protrudes to one side of each gear, and a long end 112 protrudes to the other. Each long end 112 has a set of torque transmission members, in the nature of a set of splines 114 to permit torque to be received or transmitted as may be appropriate.

The rotary gear pump is generally of the type described and illustrated in CA Patent Application No. 2310477 or US Patent Application No. 20030044299, the entire contents of which are incorporated herein by reference, where permitted, and in particular those portions which relate to the rotary gear pump.

Gears 102 and 104 are engaged such that the respective long ends of stub shafts 106 and 108 protrude to opposite sides of the matched gears, that is, one extending to in the upward axial direction, and one extending in the downward axial direction.

First and second pistons are indicated as 116 and 118. Each has a body having an eyeglass shape of first and second intersecting cylindrical lobes 119, 120 with a narrowed waist 121 inbetween. Each of the lobes has a circular cylindrical outer portion formed on a radius that closely approximates the tip radius of gears 102 and 104. Each body has a pair of parallel, first and second round cylindrical bores 122 and 123, formed in the respective first and second lobes, of a size for accommodating one or another end of stub shafts 106 and 108. The centers of the bores correspond to an appropriate centreline separation for gears 106 and 108. In the preferred embodiment of FIG. 8*a*, pistons 116 and 118 are made of steel with ceramic face plates for engaging the end faces of gears 102 and 104, and ceramic inserts that act as bushings for the respective ends of stub shafts 3 S 106 and 108.

Alternative embodiments of pistons can be used, as shown in FIGS. 8*h* and 8*i*, for example. In FIG. 8*h*, an alternative piston 115 is shown having a generally ovate form with a single relief 117 to accommodate adjacent fluid flow in the axial direction.

In FIG. 8*i*, a further alternative piston 119 has an ovate form lacking a relief, such that the adjacent surround member carries has the flow passage formed entirely therewithin.

Although pistons 116 and 118 are made of steel, as noted above, they could also be made from a metal matrix composite material having approximately 20-30% Silicon Carbide by volume, with Aluminum, Nickel and 5% (+/−) Graphite, with ceramic surfaces for engaging gears 102 and 104.

Gears 102 and 104, shafts 106 and 108, and pistons 116 and 118, when assembled, are earned within a surrounding member in the nature of a ceramic surround insert 124. Insert 124 has a round cylindrical outer wall and is contained within a mating external casing 126. External casing 126 is a steel shrink tube that is shrunk onto insert 124 such that casing 126 has a tensile pre-load and ceramic insert 124 has a corresponding compressive preload, such as may tend to discourage cracking of insert 124 in operation, and may tend to enhance service life. Insert 124 has an internal, axially extending cylindrical peripheral wall 130 of a lobate cross-section defining gear set cavity therewithin.

It is preferred that insert 124 be formed of a transformation toughened zirconia (TTZ) stabilized with magnesium. However, other materials can be used depending on the intended use. Other ceramics that can be used included, but are not limited to, alumina or silicon carbide, or alternatively, a plasma coated steel. The ceramic chosen has a similar co-efficient of thermal expansion to gears 106 and 108, pistons 116 and 118 and surround shrink tube, casing 126, to be able to function at elevated temperatures. The ceramic material also tend to be relatively resistant to abrasives. The combination of high hardness, and thermal expansion similar to steel is desirable in permitting operation with abrasive production fluids at high temperatures.

Pistons 116 and 118 can be made from silicon carbide, as noted above, or reaction bonded silicon nitride, tungsten carbide or other suitable hard wearing ceramic with or without graphite for lubricity. These materials can be shrunk fit or braised to a metal surround of substrate for high temperature applications, or to a metal matrix material for low temperature applications.

Gears 102 and 104 are made from a tough material suited to high temperature and abrasive use, such as steel alloy EN30B, cast A10Q or Superimpacto™. The material can be carburized and subjected to a vanadium process for additional hardening.

Wall 130 has first and second diametrically opposed lobes 132 and 134 each having an arcuate surface formed on a constant radius (i.e., forming part of an arc of a circle), the centers of curvature in each case being the axis of rotation of stub shafts 106 and 108 respectively, and the radius corresponding to the tip radius of gears 106 and 108.

Figure 8B:
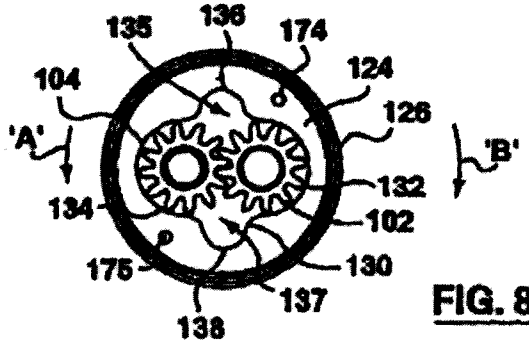
FIG. 8*b* shows an end view of the gears of the gear assembly of FIG. 8*a*.
Figure 8C:
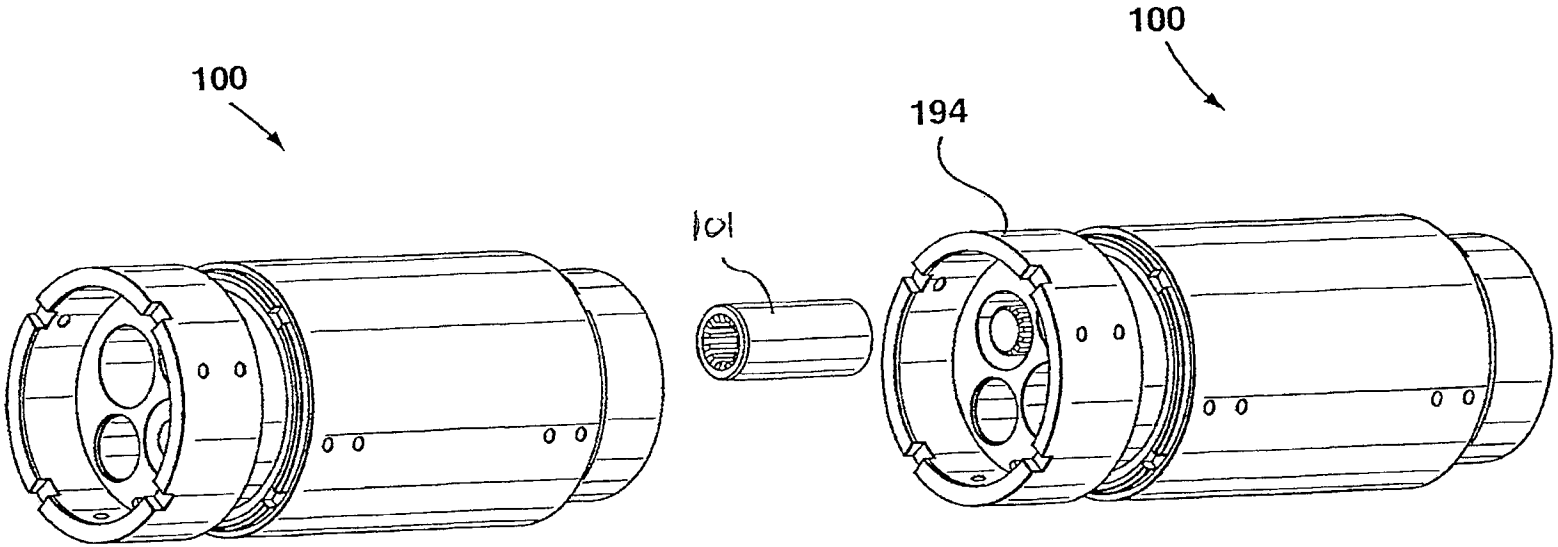
FIG. 8*c* shows an assembled perspective view of two stages of a positive displacement gear pump of FIG. 8*a*.

As such, lobes 132 and 134 describe arcuate surface walls of a pair of overlapping bores centered on the axes of shafts 106 and 108 respectively. Pistons 116 and 118 fit closely within, and are longitudinally slidable relative to, lobes 132 and 134. Wall 130 also has a pair of first and second diametrically opposed transverse outwardly extending bulges, indicated as axial fluid flow accommodating intake and exhaust lobes 136 and 138 which define respective axially extending intake and exhaust (or inlet and outlet) passages. As shown in the cross-sectional view of FIG. 8*b*, when assembled, if the gears turn in the counter-rotating directions indicated by arrow 'A' for gear 106 and arrow 'B', fluid carried at the intake passage 135 defined between lobe 136 and the waist 121 of pistons 116 and 118 can occupy the cavity defined between successive teeth of gears 106 and 108, to be swept past arcuate wall lobes 132 and 134 respectively. However, as the gears mesh, the volume of the cavities between the teeth is reduced, forcing the fluid out from between the teeth and into the exhaust passage 137 defined between lobe 138 and the waist of piston 118.

Casing 126 has a longitudinal extent that is greater than insert 124, such that when insert 124 is installed roughly centrally longitudinally within casing 126, first and second end skirts 140 and 142 of casing overhang each end of insert 124 (i.e., the skirts extend proud of the end faces of insert 124). Each of skirts 140 and 142 is internally threaded to permit engagement by a retaining sleeve 144, 146. Retaining sleeves 144 and 146 are correspondingly externally threaded, having notches to facilitate tightening, and an annular shoulder 148 that bears against whichever type of end plate adapter may be used.

In the example of FIG. 8*a*, a first end flow adapter fitting, or end plate, is indicated as end plate 150, and a second end flow adapter fitting, or second end plate, is indicated as 152. The internal features of plates 150 and 152 are described more fully below.

End plate 150 has a first end face 154, facing away from gears 106 and 108, and a second end face 156 facing toward gears 106 and 108. Externally, end plate 150 has a round cylindrical body having a smooth medial portion 158, a first end portion 160 next to end face 154, and a second end portion in the nature of a flange 162 next to second end face 156. Portion 160 is of somewhat smaller diameter than portion 158, and is externally threaded to permit mating engagement with, in general, a union nut of a next adjacent pump or motor section. Flange 162 has a circumferential shoulder 164 lying in a radial plane, such that when retaining ring 144 is tightened within casing 124, shoulder 148 of retaining ring 144 bears against shoulder 164, thus drawing end plate 150 toward gears 106 and 108.

Second end face 156 of plate 150 has a seal groove 166 into which a static seal 168 seats. Seal 168 is of a size and shape to circumscribe the entire lobate periphery of internal peripheral wall 130 of insert 124. Face 156 also has a pair of indexing recesses 170, 171 into which dowels pins 172 and 173 seat. Insert 124 has corresponding dowel pin recesses 174, 175, such that when assembled, dowel pins 172, 173 act as an alignment means in the nature of indexing pins, or alignment governors, to ensure alignment of plate 150 with insert 124 in a specific orientation. As described below, end plate 150 has a number of internal passages, and the correct alignment of those passages with stub shafts 106 and 108 and with passages 135 and 137 of insert 124 is required for satisfactory operation of unit 100. The outward face of piston 116, that is, face 178 which faces toward plate 150 (or 152) and away from gears 106 and 108, has a rebate against which an omega seal 180 can bear, with a seal backup 182 located behind seal 180.

When retaining ring 144 is tightened, seals 180, 182 and 168 are all compressed in position. If the direction of rotation of gears 102 and 104 is reversed, the role of intake and exhaust is also reversed. The ability to reverse the direction of rotation of the gearset, or to operate the gearset as a motor, depends on the seals employed. Omega seal 180 of the preferred embodiment are mono-directional seals which tend to resist leakage past face 178 from passage 137 back to passage 135. They do not work equally well in the other direction.

End plate 152 has a first end face 184, facing away from gears 106 and 108, and a second end face 186 facing toward gears 106 and 108. Externally, end plate 152 has a round cylindrical body having a smooth medial portion 188, a first end portion 190 next to end face 184, and a second end portion in the nature of a flange 192 next to second end face 186. Portion 190 is of somewhat smaller diameter than portion 188, and is externally smooth to permit longitudinal travel of a mating female union nut 194. Portion terminates in an end flange 196 having a shoulder that engages a spiral retaining ring 198 of nut 192 when nut 192 is tightened on an adjacent fitting of the next adjacent motor or pump section. Flange 192 has a circumferential shoulder 200 lying in a radial plane, such that when retaining ring 146 is tightened within casing 126, shoulder 148 of retaining ring 146 bears against shoulder 200, thus drawing end plate 152 toward gears 106 and 108.

First end face 184 is also provided with O-ring seals 197 for sealing the connection between its own fluid passages (described below) and the passages of an adjoining fitting when assembled.

Second end face 186 of plate 152 has a seal groove 166 into which another static seal 168 seats. As above, seal 168 is of a size and shape to circumscribe the entire periphery of internal peripheral wall 130 of insert 124. Face 186 also has another pair of indexing recesses 170, 171 into which further dowels pins 172 and 173 seat.

Insert 124 has corresponding dowel pin recesses 174, 175, such that when assembled, dowel pins 172, 173 act as an alignment means in the nature of indexing pins, or alignment governors, to ensure alignment of plate 132 with insert 124 in a specific orientation. As described below, end plate 152 has a number of internal passages, and the correct alignment of those passages with stub shafts 106 and 108 and with passages 135 and 137 of insert 124 is required for satisfactory operation of unit 100. The outward face of piston 118, that is, face 178 which faces toward plate 152 and away from gears 102 and 104, has a rebate against which an omega seal 180 can bear, with a seal backup 182 located behind seal 180. When retaining ring 146 is tightened, seals 180, 182 and 168 are all compressed in position, in the same manner as noted above.

When unit 100 is fully assembled, and in operation, pistons 116 and 118 are urged against the end faces of gears 102 and 104 by hydrodynamic pressure, such that hydraulic fluid will tend not to seep easily from the high pressure port to the low pressure port.

As there are neither ball nor journal bearings, and because the body of the assembly is predominantly hard, abrasion resistant ceramic, with tough, hardened steel fittings, the unit is able to operate at relatively high temperatures, that is, temperatures in excess of 180 F. The unit may tend also to be operable at temperatures up to 350 F or higher.

Figures 8D, 8E, 8F, 8G:
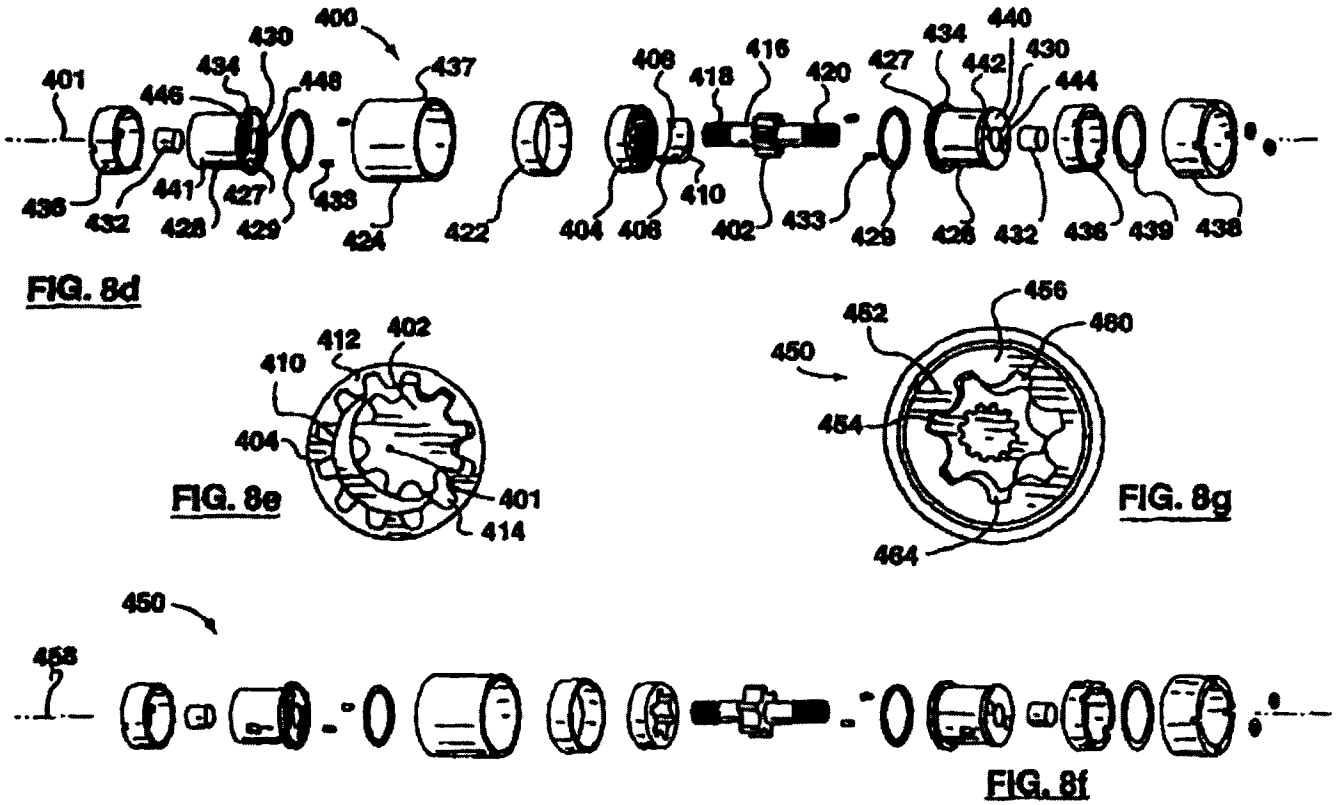
FIG. 8*d* shows an exploded view of an alternate positive displacement gear assembly to that of FIG. 8*a*.
FIG. 8*e* shows an end view of the gears of the gear assembly of FIG. 8*d*.
FIG. 8*f* shows an exploded view of a further alternate positive displacement gear assembly to that of FIG. 8*a*.
FIG. 8*g* shows an end view of the gear assembly of FIG. 8*f*.

Alternative variations of positive displacement gear pumps can also be employed. FIGS. 8*d* and 8*e* show views of a positive displacement gear assembly 400 having a first, or internal gear 402, an external ring gear 404 mounted eccentrically relative to internal gear 402, and a spacer in the nature of a floating crescent 406 mounted in the gap between gears 402 and 404. External gear 404 is mounted concentrically about the longitudinal axis 401 of gear assembly 400, generally, the axis of rotation of gear 402 being eccentric relative to axis 401. The internal concave arcuate face 408 of crescent 406 is formed on a circular arc having a radius of curvature corresponding to the outer tip radius of internal gear 402. The external, convex arcuate face 410 of crescent 406 is formed on a circular arc having a radius of curvature corresponding to the tip radius of the inwardly extending teeth of ring gear 404. As gears 402 and 404 turn, the interstitial spaces between the teeth define fluid conveying cavities, and when the teeth mesh the cavity volumes are diminished so that the fluid is forced out. Consequently, as the gears turn, fluid is transferred between intake and exhaust port regions 412 and 414.

Alternatively, when a pressure differential is established between port regions 412 and 414 gear assembly 400 acts as a motor providing output torque to shaft 416 upon which inner gear 402 is mounted. In either case, the direction of rotation will determine which is the intake port, and which is the exhaust. Shaft 416 is splined at both ends 418 and 420, permitting power transfer transmission to and from adjacent pump or motor units.

The gear set formed by gears 402 and 404, crescent 406 and shaft 416 is mounted within a round cylindrical annulus, or housing, namely ceramic insert 422, which is itself contained with a shrink-fit external steel tube casing 424. As above, casing 424 has a tensile pre-load, and imposes a compressive radial pre-load on insert 422.

First and second end plates are indicated as 426 and 428. Each has a counter sunk eccentric bore 430 for close fitting accommodation of a ceramic bushing 432 which seats about shaft 416 and has an end face that abuts one face of inner gear 402.

Bore 430 is sufficiently large at its outer end to permit engagement of an internally splined coupling by which torque can be transferred to an adjacent shaft, in a manner analogous to that described above. Each of end plates 426 and 428 has a first end face 427 that locates adjacent a face of ring gear 404, and has an outer peripheral seal groove and a static seal 429 seated therein to bear against a shoulder of insert 422. Locating means, in the nature of indexing sockets and mating dowel pins 433 determine the orientation of end plates 426 and 428 relative to the respective axes of rotation of gears 402 and 404, and to each other.

End plate 426 is nominally the upward end plate of the assembly, and has a flange 434 to be engaged by a retaining ring 436. Retaining ring 436 is externally threaded and engages the internally threaded overhanging upward end skirt 437 of casing 424 in the manner of retainer 44 and skirt 140 described above. A union nut 438 and retaining ring 439 engage and end face flange 440 in the manner of union nut 194 described above. End plate 428 is the same as end plate 426 externally, with the exception that the distal portion 441 is externally threaded to mate with a union nut of an adjacent pump or motor assembly, or other fitting.

Internally, end plates 426 and 428 each have a pair of parallel, round cylindrical longitudinally extending bores 442 and 444 let inward from the end face most distant from gears 402 and 404, and extending toward gears 402 and 404, defining respective internal passageways. Each has an enlarged port 446, 448 in the nature of an arcuate, circumferentially extending rebate at the respective end face 427 of plate 426 or 428 that is located adjacent to gears 402 and 404. These rebates act as intake and exhaust galleries for gears 402 and 404, the function depending on the direction of rotation of the gears.

Given the symmetrical nature of assembly 400, it can be seen that it can be operated either as a motor or as a pump, and, with appropriate interconnection transition plates analogous to plates 80, and 86, several units can be ganged together as parallel (or, serial) pump stages or motor stages, with the shafting and splined couplings permitting transmission of mechanical torque between the various stages.

A further alternative gear assembly is shown in FIGS. 8*f* and 8*g* as 450. All of the components of assembly 450 are the same as those of assembly 400 of FIGS. 4*c* and 4*d* described above, except that in place of the positive displacement gear assembly of gear 402, gear 404 and crescent 406, assembly 450 employs a positive displacement gear assembly in the nature of a gerotor assembly 452. Gerotor assembly 452 has an inner gerotor element 454 and a mating outer gerotor element 456. Outer gerotor element 456 is concentric with the longitudinal centerline 458 of assembly 450 generally, and inner gerotor element 454 is mounted on an eccentric parallel axis. In the manner of gerotors generally, as the gerotor elements turn, variable geometry cavities defined between respective adjacent lobes of the inner and outer elements expand and contract, drawing in fluid at an intake side 460, and expelling it at an exhaust region 464 (as before, intake and exhaust depend on the direction of rotation of the elements). As above, appropriate porting permits assembly 450 to be used as a motor or a pump, and several units can be linked together to form a multi-stage pump or multistage motor. Shafting and splined couplings can be used to transfer mechanical torque from stage to stage.

Definitions and Interpretation

The singular forms "a," "an," and "the" include plural reference unless the context clearly dictates otherwise. Thus, for example, a reference to "a plant" includes a plurality of such plants. It is further noted that the claims may be drafted to exclude any optional element. As such, this statement is intended to serve as antecedent basis for the use of exclusive terminology, such as "solely," "only," and the like, in connection with the recitation of claim elements or use of a "negative" limitation. The terms "preferably," "preferred," "prefer," "optionally," "may," and similar terms are used to indicate that an item, condition or step being referred to is an optional (not required) feature of the invention.

The term "and/or" means any one of the items, any combination of the items, or all of the items with which this term is associated. The phrase "one or more" is readily understood by one of skill in the art, particularly when read in context of its usage.

As will also be understood by one skilled in the art, all language such as "up to", "at least", "greater than", "less than", "more than", "or more", and the like, include the number recited and such terms refer to ranges that can be subsequently broken down into sub-ranges as discussed above. In the same manner, all ratios recited herein also include all sub-ratios falling within the broader ratio. Accordingly, specific values recited for radicals, substituents, and ranges, are for illustration only; they do not exclude other defined values or other values within defined ranges for radicals and substituents.

One skilled in the art will also readily recognize that where members are grouped together in a common manner, such as in a Markush group, the invention encompasses not only the entire group listed as a whole, but each member of the group individually and all possible subgroups of the main group. Additionally, for all purposes, the invention encompasses not only the main group, but also the main group absent one or more of the group members. The invention therefore envisages the explicit exclusion of any one or more of members of a recited group. Accordingly, provisos may apply to any of the disclosed categories or embodiments whereby any one or more of the recited elements, species, or embodiments, may be excluded from such categories or embodiments, for example, as used in an explicit negative limitation.

The invention claimed is:

1. A downhole pumping apparatus comprising:

a positive displacement rotary gear pump (RGP) comprising an input shaft, driven by a rotating rod string or a submersible electric motor comprising an output shaft, wherein an axial center line of the input shaft is parallel to but offset from an axial center line of the rotating rod string or the output shaft;

a flex coupling that transmits, by contact with the input shaft, rotational torque from the rotating rod string or the output shaft to the input shaft; and a cylindrical housing enclosing the rotary gear pump and the flex coupling.

2. The apparatus of claim 1 wherein the RGP is driven by the rotating rod string.

3. The apparatus of claim 2 wherein the rotating rod string comprises a drive extension having a splined male end which mates with a splined engagement coupling, wherein the flex coupling is disposed between the engagement coupling and the input shaft of the RGP.

4. The apparatus of claim 2, wherein the flex coupling comprises an assembly comprising a connecting shaft having:

(a) a first end with a first enlarged body bearing splines, which is received into a first splined bore in a first housing which is rigidly connected to the input shaft of the RGP; and (b) a second end with a second enlarged body bearing splines, which is received into a second splined bore in a second housing which is rigidly connected to the rotating rod string.

5. The apparatus of claim 1 wherein the RGP is driven by the motor which is an AC induction motor or a permanent magnet motor.

6. The apparatus of claim 5 further comprising a speed reducing or speed increasing gearbox disposed between the RGP and the motor.

7. The apparatus of claim 6 wherein the motor is mounted above the RGP.

8. The apparatus of claim 7 wherein the pumping apparatus is conveyed on coiled tubing.

9. The apparatus of claim 7 comprising a packer disposed on the pump between an intake and a pump discharge head, the packer configured to mate with a pump seating nipple installed in a casing or a liner.

10. The apparatus of claim 8, further comprising an oil conduit configured to supply pressurized clean lubricating oil to the motor and/or a seal section from a surface source to maintain positive pressure inside the motor and seal section, and/or to periodically flush the motor and seal section with clean lubricating oil.

11. The apparatus of claim 7 wherein the pumping apparatus is conveyed on a cable.

12. The apparatus of claim 11 comprising a packer disposed on the pump between an intake and a pump discharge head, the packer configured with a surface control line to expand from a running shape to an installed shape, holding the pump in place in a liner or in a casing.

13. The apparatus of claim 11, further comprising an oil conduit configured to supply pressurized clean lubricating oil to the motor and/or a seal section from a surface source to maintain positive pressure inside the motor and seal section, and/or to periodically flush the motor and seal section with clean lubricating oil.

14. The apparatus of claim 5 wherein the motor is mounted below the RGP.

15. The apparatus of claim 14 wherein the RGP is conveyed on production tubing and further comprises a sensor operatively connected to the motor to vary motor operation.

16. The apparatus of claim 15 further comprising a speed increasing or decreasing gearbox disposed between the motor and the RGP.

17. The apparatus of claim 14 further comprising a speed increasing or decreasing gearbox disposed between the motor and the RGP.

18. The apparatus of claim 17 further comprising an oil/gas separator associated with a RGP intake.

19. The apparatus of claim 14 further comprising an oil/gas separator associated with a RGP intake.

20. The apparatus of claim 5, wherein the flex coupling comprises an assembly comprising a connecting shaft having:

(a) a first end with a first enlarged body bearing splines, which is received into a first splined bore in a first housing which is rigidly connected to the input shaft of the RGP; and (b) a second end with a second enlarged body bearing splines, which is received into a second splined bore in a second housing which is rigidly connected to the output shaft of the motor.

* * * * *